US010167745B2

(12) United States Patent
Suzuki et al.

(10) Patent No.: US 10,167,745 B2
(45) Date of Patent: Jan. 1, 2019

(54) VARIABLE VALVE MECHANISM OF INTERNAL COMBUSTION ENGINE

(71) Applicant: OTICS CORPORATION, Nishio-shi (JP)

(72) Inventors: Hiroyuki Suzuki, Nishio (JP); Akira Sugiura, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 101 days.

(21) Appl. No.: 15/419,836

(22) Filed: Jan. 30, 2017

(65) Prior Publication Data

US 2017/0268386 A1 Sep. 21, 2017

(30) Foreign Application Priority Data

Mar. 18, 2016 (JP) ..... 2016-055014

(51) Int. Cl.
*F01L 1/18* (2006.01)
*F01L 1/22* (2006.01)
(Continued)

(52) U.S. Cl.
CPC ..... *F01L 1/22* (2013.01); *F01L 1/181* (2013.01); *F01L 1/185* (2013.01); *F01L 1/462* (2013.01); *F01L 13/0036* (2013.01); *F01L 13/0005* (2013.01); *F01L 2001/186* (2013.01); *F01L 2001/467* (2013.01); *F01L 2105/00* (2013.01); *F01L 2820/02* (2013.01)

(58) Field of Classification Search
CPC ..... F01L 1/185; F01L 2001/186; F01L 2001/467; F01L 13/0005; F01L 2105/00
USPC ..... 123/90.39, 90.41, 90.44
See application file for complete search history.

(56) References Cited

U.S. PATENT DOCUMENTS 6,532,920 B1 3/2003 Sweetnam et al.
2009/0114177 A1 5/2009 Manther et al.
(Continued)

FOREIGN PATENT DOCUMENTS

EP 3 012 421 A1 4/2016
JP 2017166460 A * 9/2017 ..... F01L 1/181
WO WO 2017/004179 A1 1/2017

OTHER PUBLICATIONS

Great Britain Search Report dated Aug. 24, 2017 in GB Application No. 1703762.3.

*Primary Examiner* — Jorge Leon, Jr.
(74) *Attorney, Agent, or Firm* — McGinn I. P. Law Group, PLLC.

(57) ABSTRACT

A variable valve mechanism of an internal combustion engine includes an outer arm, an inner arm, a switching device that switches between a coupled state and a non-coupled state, and a lost motion spring. The lost motion spring has an extending portion extending from the outside of the space to the inside of the space. The extending portion has a contact portion that is in contact with the inner arm in the space and being configured to swing in conjunction with swinging of the inner arm. A through-hole is formed in a vertically intermediate portion of the outer arm such that connecting portions are provided at vertically opposite sides of the through-hole, and a portion of the extending portion, a swinging amount of which is smaller than that of the contact portion, passes through the through-hole that allows the portion to swing therein.

5 Claims, 5 Drawing Sheets

(51) Int. Cl.
*F01L 1/46* (2006.01)
*F01L 13/00* (2006.01)

(56) References Cited

U.S. PATENT DOCUMENTS

2012/0037107 A1* 2/2012 Church ..... F01L 1/185
123/90.41
2012/0266835 A1* 10/2012 Harman ..... F01L 1/185
123/90.39
2014/0290608 A1* 10/2014 Radulescu ..... F01L 1/46
123/90.39
2015/0275712 A1* 10/2015 Manther ..... F01L 13/0036
123/90.16
2016/0102584 A1* 4/2016 Evans ..... F01L 1/185
123/90.45

* cited by examiner

VARIABLE VALVE MECHANISM OF INTERNAL COMBUSTION ENGINE

TECHNICAL FIELD

The present invention relates to a variable valve mechanism that drives a valve of an internal combustion engine and changes the drive state of the valve in accordance with the operating status of the internal combustion engine.

BACKGROUND ART

A variable valve mechanism includes: an outer arm; an inner arm provided inside the outer arm; a switching device that switches between a coupled state in which the inner arm and the outer arm are coupled together and a non-coupled state in which this coupling is released; and a lost motion spring that biases the inner arm toward a cam in the non-coupled state. Examples of a document describing such a variable valve mechanism include Patent Document 1 and Patent Document 2 described below.

In Patent Document 1, a lost motion spring is hooked, from the outside of an outer arm through a portion above the outer arm, onto an inner arm disposed inside.

In Patent Document 2, a slot (long hole) extending in a swinging direction of an inner arm is formed in an outer arm. A spring hooking portion formed on the inner arm in a protruding manner protrudes through the slot to a side of the outer arm. A lost motion spring is hooked onto the spring hooking portion on the side of the outer arm.

CITATION LIST

Patent Document

[Patent Document 1] US Patent Application Publication No. 2015/0275712

[Patent Document 2] US Patent Application Publication No. 2014/0290608

SUMMARY OF INVENTION

Technical Problem

In Patent Document 1, an area through which the lost motion spring is installed from the portion above the outer arm requires space for this installation, which restricts the thickness of an upper portion of the outer arm. Consequently, the outer arm is structured such that the outer arm materials are connected only below this area, and thus the strength of the outer arm may decrease.

In contrast to Patent Document 1, a structure can be used in which a lost motion spring is installed from a portion below an outer arm. However, in this structure, an area through which the lost motion spring is installed from the portion below the outer arm requires space for this installation, which restricts the thickness of a lower portion of the outer arm. Consequently, the outer arm is structured such that the outer arm materials are connected only above this area, and thus the strength of the outer arm may decrease in the same manner as in Patent Document 1.

In Patent Document 2, the outer arm materials are connected at vertically opposite sides of the slot, and therefore, the strength of the outer arm is relatively high. However, the swinging amount of the inner arm is restricted depending on the length of the slot in the swinging direction. On the other hand, if the length of the slot is increased, the strength of the outer arm may decrease.

In view of this, it is an object of the present invention to increase the strength of an outer arm and obtain a sufficiently large swinging amount of an inner arm.

Solution to Problem

In order to accomplish this object, a variable valve mechanism of the present invention is structured as follows. Specifically, the variable valve mechanism includes: an outer arm that drives a valve when being swung and has a space formed in an intermediate portion thereof in a width direction; an inner arm that is swingably provided in the space and is driven by a cam to swing; a switching device that switches between a coupled state in which the inner arm and the outer arm are coupled so as to integrally swing and a non-coupled state in which this coupling is released; and a lost motion spring that biases the inner arm toward the cam in the non-coupled state.

This variable valve mechanism of an internal combustion engine has the following characteristics. Specifically, the lost motion spring has an extending portion extending from the outside of the space to the inside of the space. The extending portion has a contact portion that is in contact with the inner arm in the space, and is configured to swing in conjunction with swinging of the inner arm. A through-hole is formed in a vertically intermediate portion of the outer arm such that connecting portions where the outer arm materials are connected, are provided at vertically opposite sides of the through-hole. A portion of the extending portion, a swinging amount of which is smaller than that of the contact portion, passes through the through-hole that allows the portion to swing therein.

Advantageous Effects of Invention

According to the present invention, the through-hole through which the extending portion of the lost motion spring passes is formed such that the connecting portions are provided at the vertically opposite sides thereof. Thus, compared with the structures (Patent Document 1, etc.) in each of which the outer arm materials are connected only in an upper area or only in a lower area, high strength of the outer arm can be obtained.

The through-hole is formed such that the portion of the extending portion, the swinging amount of which is smaller than that of the contact portion, passes therethrough. Accordingly, a sufficiently large swinging amount can be obtained at the contact portion without significantly increasing the length of the through-hole in the spring swinging direction (swinging direction of the extending portion). Thus, it is possible to obtain a sufficiently large swinging amount of the inner arm while achieving a sufficiently high strength of the outer arm.

BRIEF DESCRIPTION OF DRAWINGS

FIG. 3A is a sectional view taken along line IIIa-IIIa in FIG. 4A, and FIG. 3B is a sectional view taken along line IIIb-IIIb in FIG. 4A;

DESCRIPTION OF EMBODIMENTS

Figure 1:
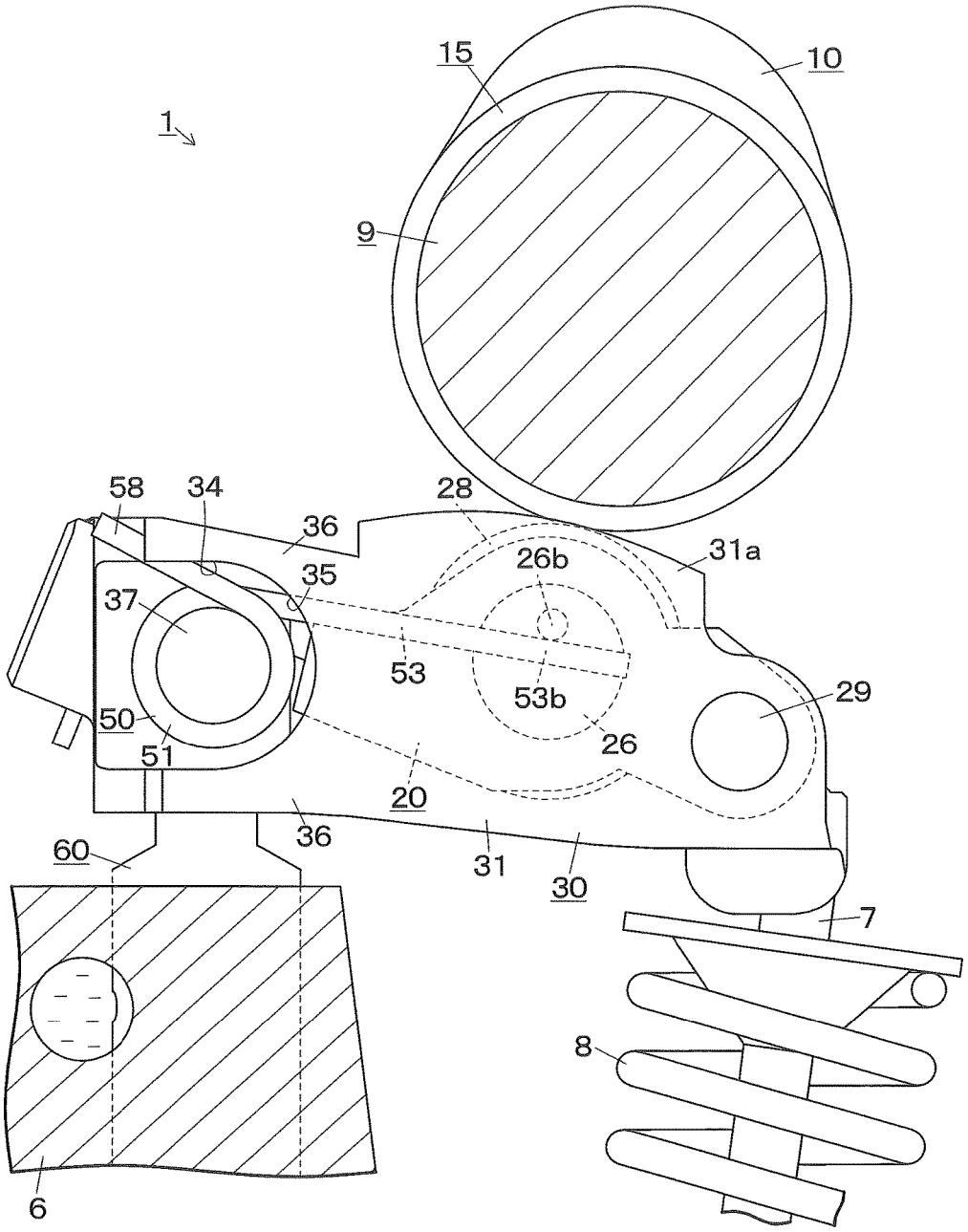
FIG. 1 is a side view of a variable valve mechanism of an embodiment.

Examples of modes of the lost motion spring include, but not limited to, the following modes:

[i] a mode in which the lost motion spring is a leaf spring that has only the extending portion described above; and

[ii] a mode in which the lost motion spring has a coil portion disposed outside the space and the extending portion extending from the coil portion to the inside of the space.

Although arrangement, for example, of the lost motion spring is not limited to a particular one, the through-hole is preferably arranged as close as possible to the base end of the extending portion. This is because such arrangement can reduce the length of the through-hole in the spring swinging direction. Specifically, in the extending portion, the length from the base end through the through-hole to a position adjacent to the space is preferably equal to or shorter than 50% of the length from the base end to a position at the contact portion, and is more preferably equal to or shorter than 40% thereof.

Although a specific mode of the outer arm and other components is not limited to a particular one, the following mode is preferable in that the through-hole is positioned near the base end of the extending portion. That is, in the outer arm, an accommodating portion that accommodates the coil portion is formed. Part of this accommodating portion communicates with the space, and this communicating part forms the through-hole.

Embodiment

The following describes an embodiment of the present invention. It should be noted that the present invention is not limited to the embodiment, and structures and shapes of various components may be optionally modified for implementation without departing from the gist of the invention.

A variable valve mechanism 1 of the embodiment illustrated in FIG. 1 to FIG. 5B is a mechanism in which a valve 7 to which a valve spring 8 is attached is periodically pressed so that the valve 7 is opened and closed. This variable valve mechanism includes a cam 10, an inner arm 20, an outer arm 30, a switching device 40, and lost motion springs 50. Hereinafter, the width direction of the outer arm 30 is called the right-and-left direction, and the longitudinal direction of the outer arm 30 is called the front-and-rear direction. The swinging direction of an extending portion 53 of each lost motion spring 50 with respect to the outer arm 30 in a non-coupled state is called the spring swinging direction, and the swinging amount of each part of the extending portion 53 with respect to the outer arm 30 in the non-coupled state is called the spring swinging amount of the part.

[Cam 10]

Figure 2:
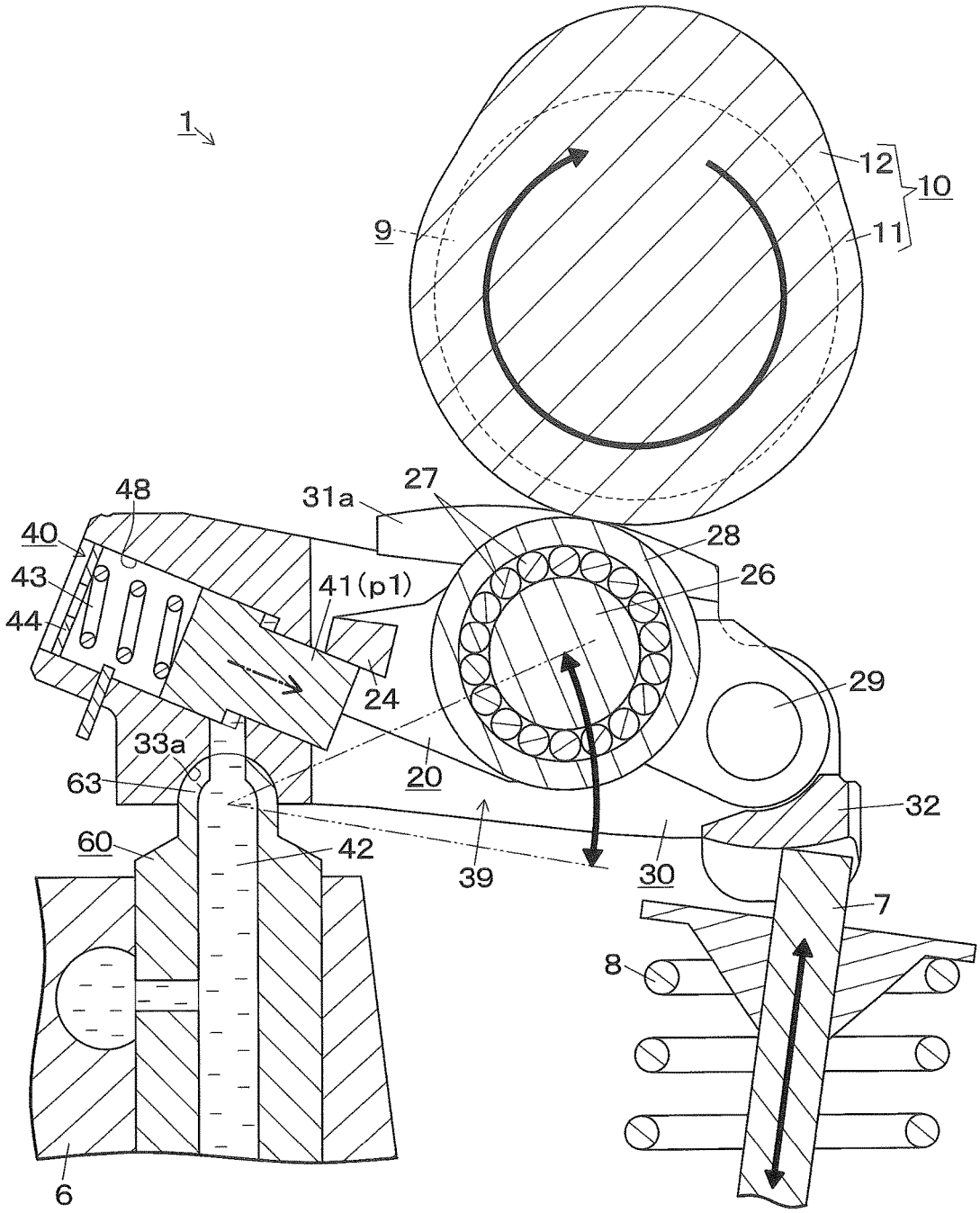
FIG. 2 is a side sectional view illustrating a coupled state in the variable valve mechanism.

As depicted in FIG. 1, for example, the cam 10 is provided to a camshaft 9 that rotates once every time an internal combustion engine rotates twice, and rotates integrally with the camshaft 9. As depicted in FIG. 2, for example, this cam 10 has a base circle 11 having a circular cross-section and a nose 12 protruding from the base circle 11. As depicted in FIG. 1, for example, at portions of camshaft 9 that are positioned on both right and left sides of the cam 10, inactive cams 15 each formed of only a base circle are provided.

[Inner Arm 20]

Figure 3A:
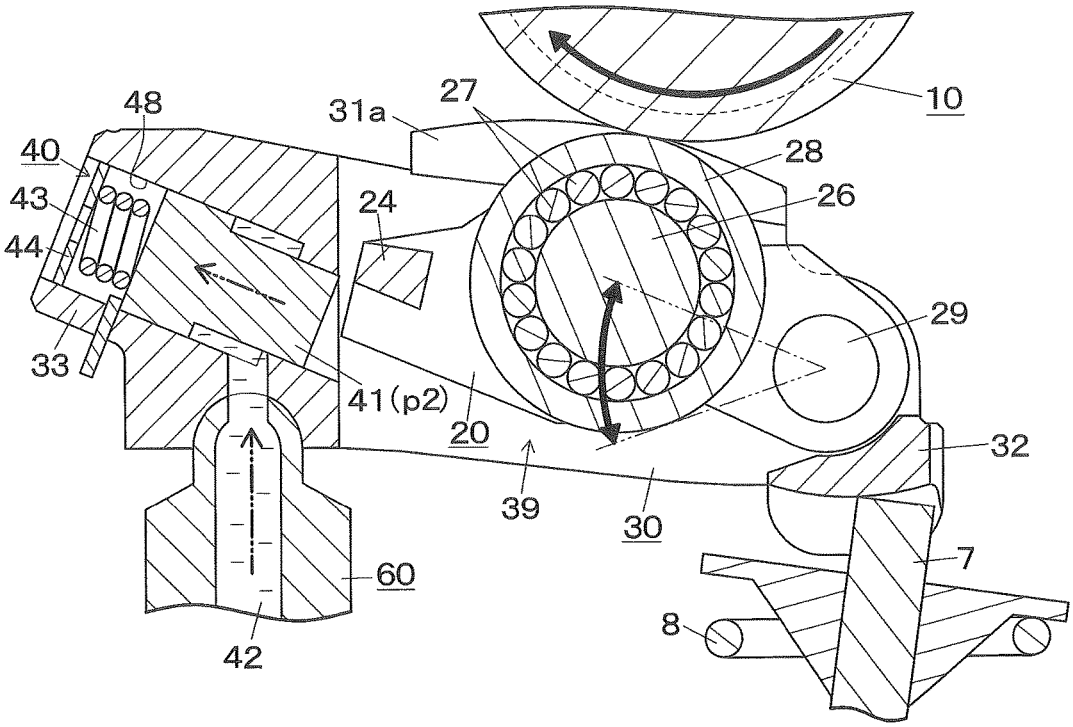
FIGS. 3A and 3B are side sectional views illustrating a non-coupled state in the variable valve mechanism.
Figure 3B:
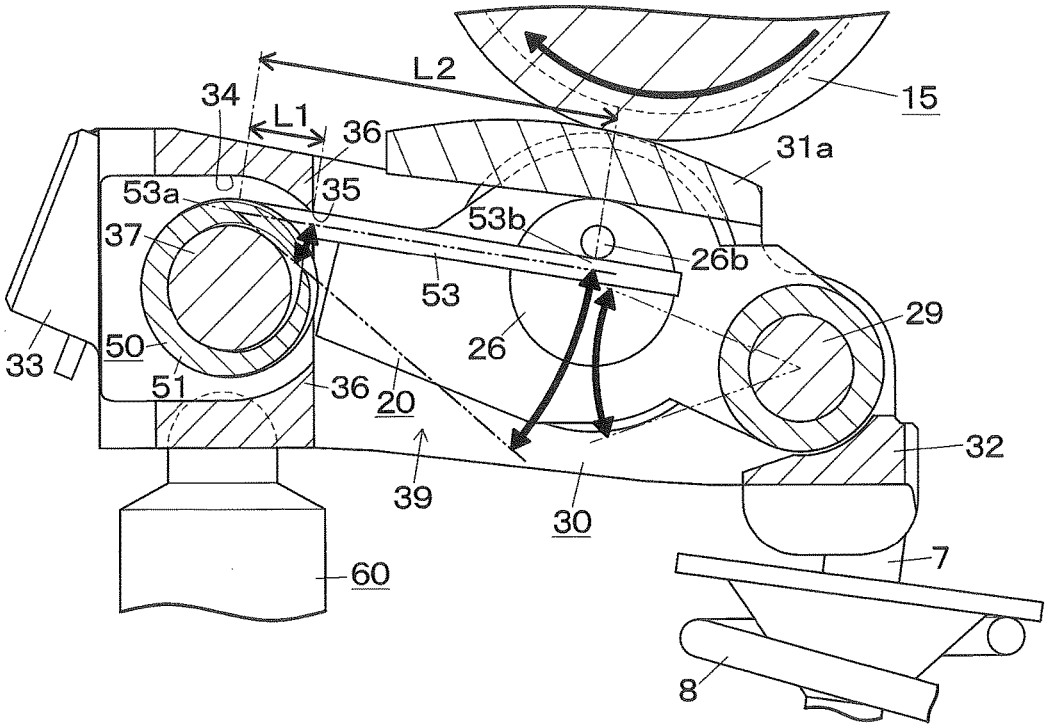
Figure 4A:
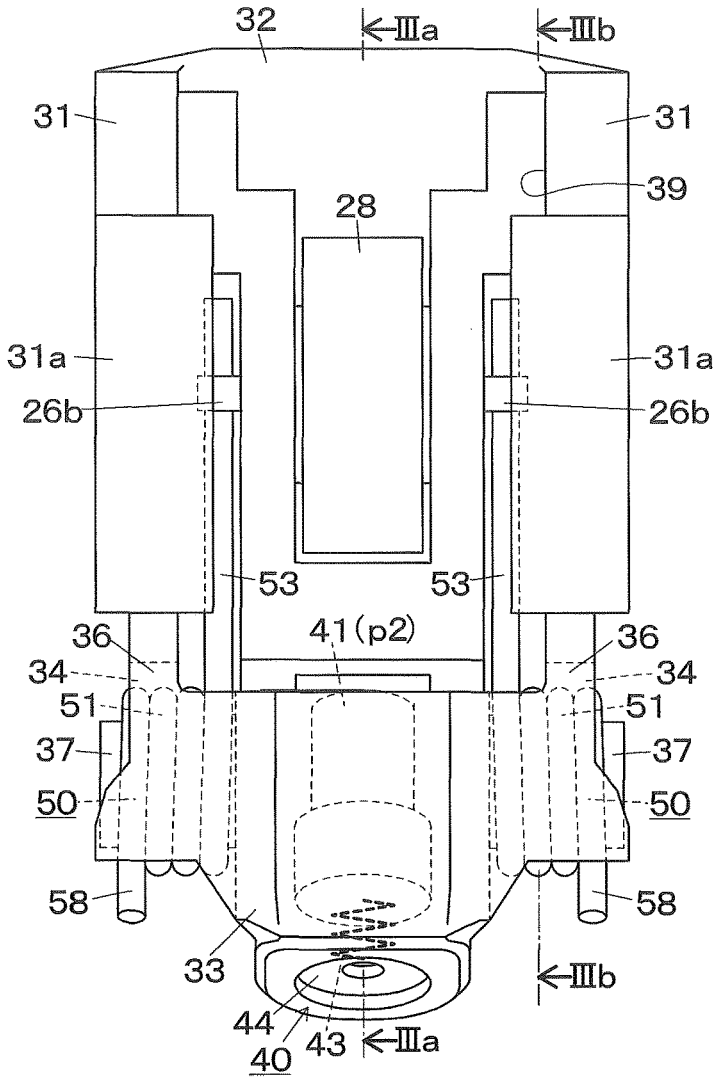
FIG. 4A is a plan view of the variable valve mechanism.
Figure 4B:
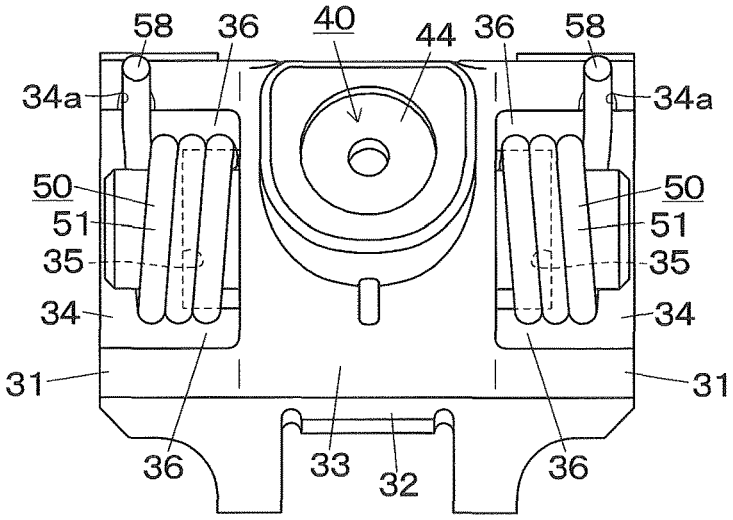
FIG. 4B is a rear view thereof.

As depicted in FIGS. 4A and 4B, for example, the inner arm 20 is provided in a space 39 of the outer arm 30. As depicted in FIG. 2, for example, a front-end portion of the inner arm 20 is rotatably connected to a front-end portion of the outer arm 30 so that the inner arm 20 can swing about a shaft member 29. To a rear-end portion of the inner arm 20, a roller 28 that is in contact with the cam 10 is attached via a roller shaft 26 and a bearing 27 so as to be rotatable. As depicted in FIG. 3B, for example, on both sides of the roller shaft 26, engaging protrusions 26*b* are provided.

[Outer Arm 30]

As depicted in FIGS. 4A and 4B, for example, the outer arm 30 includes side-plate portions 31 that are provided on both right and left sides of the inner arm 20 and a base portion 33 that connects rear ends of the right and left side-plate portions 31 to each other, so that the outer arm 30 is formed in a U-shape that is open to the front. The inside of the U-shape forms the space 39. Thus, the outer arm 30 has the space 39 in its central portion in the width direction. Lower end portions of front-end portions of the right and left side-plate portions 31 are connected to each other by a bridge portion 32. As depicted in FIG. 2, for example, the outer arm 30 is swingably supported by a hemispherical portion 63 that is the upper end of a pivot 60 at a hemispherical recessed portion 33*a* that is a recess provided in a lower surface of the base portion 33. The bridge portion 32 is in contact with the stem end of the valve 7. On upper end portions of the right and left side-plate portions 31, slippers 31*a* that are in sliding contact with the inactive cams 15 are provided.

Figure 5A:
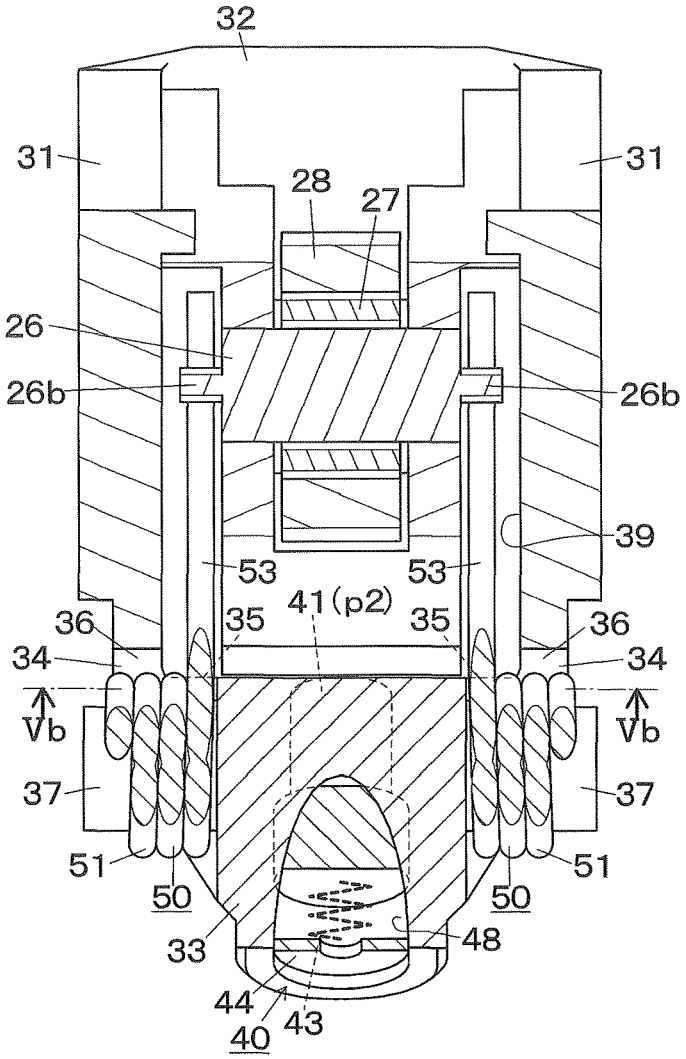
FIG. 5A is a plan sectional view (sectional view taken along line Va-Va in FIG. 5B) of the variable valve mechanism.
Figure 5B:
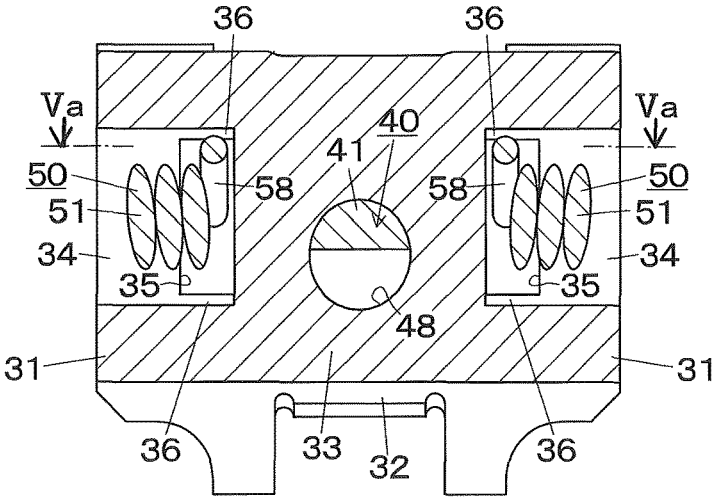
FIG. 5B is a rear sectional view (sectional view taken along line Vb-Vb in FIG. 5A) thereof.

As depicted in FIGS. 5A and 5B, for example, a left accommodating portion 34 is formed in a portion between the left side-plate portion 31 and the base portion 33, and a right accommodating portion 34 is formed in a portion between the right side-plate portion 31 and the base portion 33. Specifically, the left accommodating portion 34 is open to both the left and the rear, and the right accommodating portion 34 is open to both the right and the rear. Furthermore, the front side of each of the right and left accommodating portions 34 partly communicates with the space 39. These communicating parts form through-holes 35. Thus, these through-holes 35 are each formed in a vertically intermediate portion of the outer arm 30 such that connecting portions 36 where the outer arm materials are connected, are provided at vertically opposite sides of each through-hole 35. Each through-hole 35 is a hole through which a portion of the extending portion 53 of a corresponding one of the lost motion springs 50 passes. The spring swinging amount of the portion is smaller than that of a contact portion 53*b* of the extending portion 53, and the through-hole 35 allows the portion to swing therein. Protrusions 37 are formed inside the right and left accommodating portions 34 such that the protrusions 37 extend outward to the right and to the left from the respective right and left inner walls.

[Switching Device 40]

As depicted in FIG. 2, for example, the switching device 40 includes a switching pin 41, an oil passage 42, and a spring 43. The switching pin 41 is attached in a pin hole 48 formed in a penetrating manner in a central portion of the base portion 33 of the outer arm 30 in the right-and-left direction and extending in the front-and-rear direction, and is provided movably between a coupling position p1 on the front side and a non-coupling position p2 on the rear side. As depicted in FIG. 2, for example, the coupling position p1 on the front side is a position where a front-end portion of the switching pin 41 protrudes from the base portion 33 into the space 39 in front such that the front-end portion fits in under a rear-end portion 24 of the inner arm 20. When the switching pin 41 is positioned in the coupling position p1, as indicated by an arrow in FIG. 2, the inner arm 20 and the outer arm 30 integrally swing about the hemispherical portion 63 of the pivot 60 as an axis to drive the valve 7. As depicted in FIG. 3A, for example, the non-coupling position p2 on the rear side is a position where the front-end portion of the switching pin 41 retreats into the base portion 33, so that the front-end portion does not fit in under the rear-end portion 24 of the inner arm 20. When the switching pin is positioned in the non-coupling position p2, as indicated by an arrow in FIG. 3A, the inner arm 20 swings (swings in an idle manner) about the shaft member 29 as an axis with respect to the outer arm 30 to stop driving the valve 7.

The oil passage 42 is a passage for supplying hydraulic pressure that moves the switching pin 41 to the non-coupling position p2 on the rear side. This oil passage 42 extends from a cylinder head 6 to the pin hole 48 of the outer arm 30 via the pivot 60. In the non-coupled state, as depicted in FIG. 3A, for example, hydraulic pressure is applied to the switching pin 41 rearward. The spring 43 is a member configured to move the switching pin 41 to the coupling position p1 on the front side as depicted in FIG. 2, for example, when the hydraulic pressure in the oil passage 42 decreases, and is disposed on the rear side of the switching pin 41 in the pin hole 48. A rear-end portion of the spring 43 is retained by a retainer 44 attached near a rear-end portion of the pin hole 48.

[Lost Motion Springs 50]

The lost motion springs 50 are springs configured to bias the inner arm 20 toward the cam 10 in the non-coupled state. As depicted in FIGS. 4A and 4B, for example, the left lost motion spring 50 and the right lost motion spring 50 are provided. Each lost motion spring 50 includes a coil portion 51, the extending portion 53, and a second extending portion 58.

The coil portion 51 is a coil-shaped portion, and is fitted onto a corresponding one of the protrusions 37 to be accommodated in a corresponding one of the accommodating portions 34.

As depicted in FIG. 3B, for example, the extending portion 53 extends from the coil portion 51 to the inside of the space 39 through the through-hole 35, and a distal end portion thereof is in contact with the engaging protrusion 26*b* of the roller shaft 26 from below so as to engage therewith. This contact portion serves as the contact portion 53*b* between the inner arm 20 and the extending portion 53. In the non-coupled state, as indicated by an arrow in FIG. 3B, this extending portion 53 swings with respect to the outer arm 30 in conjunction with swinging of the inner arm 20. In the extending portion 53, the length L1 from a base end 53*a* through the through-hole 35 to a position adjacent to the space 39 is 5 to 40% of the length L2 from the base end 53*a* to a position at the contact portion 53*b*.

As depicted in FIG. 1, for example, the second extending portion 58 extends rearward and upward in a slanting manner from the coil portion 51. As depicted in FIG. 4B, for example, a rear-end portion of each second extending portion 58 is locked on a locking portion 34*a* provided on an upper surface of a corresponding one of the accommodating portions 34. Thus, force applied to the contact portion 53*b* from the inner arm 20 is transmitted to the locking portion 34*a* via the extending portion 53, the coil portion 51, and the second extending portion 58. At this time, the coil portion 51 is deflected, whereby biasing force that biases the inner arm 20 toward the cam 10 is generated.

According to the embodiment, the following effects can be obtained. Specifically, each through-hole 35 through which the extending portion 53 of a corresponding one of the lost motion springs 50 is disposed is formed such that the connecting portions 36 are provided at the vertically opposite sides of the through-hole 35. Thus, compared with the structures (Patent Document 1, etc.) in each of which the outer arm materials are connected only in an upper area or only in a lower area, high strength can be obtained. When the strength is sufficiently high, weight can be reduced.

The through-hole 35 is formed such that the portion of the extending portion 53, the spring swinging amount of which is smaller than that of the contact portion 53*b*, passes therethrough. Accordingly, a sufficiently large spring swinging amount can be obtained at the contact portion 53*b* without significantly (to such an extent that the strength decreases) increasing the length of the through-hole 35 in the spring swinging direction. Thus, it is possible to obtain a sufficiently large swinging amount of the inner arm 20 while achieving a sufficiently high strength of the outer arm 30.

REFERENCE SIGNS LIST

1. Variable valve mechanism
7. Valve
10. Cam
20. Inner arm
30. Outer arm
34. Accommodating portion
35. Through-hole
36. Connecting portion
39. Space
40. Switching device
50. Lost motion spring
51. Coil portion
53. Extending portion
53*a* Base end of extending portion
53*b* Contact portion of extending portion
L1 Length from base end of extending portion to position adjacent to space
L2 Length from base end of extending portion to position at contact portion

The invention claimed is:

1. A variable valve mechanism of an internal combustion engine, the variable valve mechanism comprising:

an outer arm that drives a valve when being swung and has a space formed in an intermediate portion thereof in a width direction;

an inner arm that is swingably provided in the space and is driven by a cam to swing;

a switching device that switches between a coupled state in which the inner arm and the outer arm are coupled so as to integrally swing and a non-coupled state in which the coupled state is released; and a lost motion spring that biases the inner arm toward the cam in the non-coupled state, wherein the lost motion spring has an extending portion extending from an outside of the space to an inside of the space, the extending portion having a contact portion that is in contact with the inner arm in the space and being configured to swing in conjunction with swinging of the inner arm, and wherein a through-hole is formed in a vertically intermediate portion of the outer arm such that connecting portions are provided at vertically opposite sides of the through-hole, and a portion of the extending portion, a swinging amount of which is smaller than that of the contact portion, passes through the through-hole that allows the portion of the extending portion to swing therein.

2. The variable valve mechanism of an internal combustion engine according to claim 1, wherein the lost motion spring has a coil portion disposed outside the space and the extending portion extending from the coil portion to the inside of the space, and wherein, in the extending portion, a length from a base end of the extending portion through the through-hole to a position adjacent to the space is equal to or shorter than 50% of a length from the base end to a position at the contact portion.

3. The variable valve mechanism of an internal combustion engine according to claim 2, wherein an accommodating portion that accommodates the coil portion is formed in the outer arm, part of the accommodating portion communicates with the space, and a communicating part forms the through-hole.

4. The variable valve mechanism of an internal combustion engine according to claim 2, wherein the outer arm includes right and left side-plate portions and a base portion that connects rear ends of the right and left side-plate portions to each other, wherein a left accommodating portion that accommodates a left coil portion is formed in a portion between the left side-plate portion and the base portion, wherein a right accommodating portion that accommodates a right coil portion is formed in a portion between the right side-plate portion and the base portion, and wherein a front side of each of the right and left accommodating portions partly communicates with the space, and communicating parts form the through-holes.

5. The variable valve mechanism of an internal combustion engine according to claim 1, wherein a roller that is in contact with the cam is rotatably attached to the inner arm via a roller shaft and a bearing, and the contact portion is in contact with an engaging protrusion that is formed on an end portion of the roller shaft.

* * * * *